US008579138B2

(12) United States Patent
Jamison et al.

(10) Patent No.: US 8,579,138 B2
(45) Date of Patent: Nov. 12, 2013

(54) COCKTAIL GLASS COVER

(76) Inventors: Will C. Jamison, Carson, CA (US); Lynette P. Jamison, Carson, CA (US)

( * ) Notice: Subject to any disclaimer, the term of this patent is extended or adjusted under 35 U.S.C. 154(b) by 80 days.

(21) Appl. No.: 13/273,946

(22) Filed: Oct. 14, 2011

(65) Prior Publication Data

US 2012/0091142 A1 Apr. 19, 2012

Related U.S. Application Data

(60) Provisional application No. 61/394,207, filed on Oct. 18, 2010.

(51) Int. Cl.

| | |
|---|---|
| ***B65D 51/12*** | (2006.01) |
| ***B65D 51/00*** | (2006.01) |
| ***B65D 51/16*** | (2006.01) |
| ***A47G 19/22*** | (2006.01) |

(52) U.S. Cl.

USPC ..... 220/212.5; 220/213; 220/254.1; 220/254.7; 220/287; 220/367.1; 220/371; 220/705; 220/709; 220/711; 220/713; 215/228; 215/229

(58) Field of Classification Search

USPC ..... 220/212.5, 213, 254.1, 254.7, 287, 220/367.1, 369, 370, 371, 372, 705, 709, 220/711, 713; 215/228, 229

See application file for complete search history.

(56) References Cited

U.S. PATENT DOCUMENTS

| | | | | |
|---|---|---|---|---|
| 5,573,139 | A * | 11/1996 | Yeh | 220/360 |
| 8,100,287 | B2 * | 1/2012 | Milnark | 220/709 |
| 2005/0077303 | A1 | 4/2005 | Minner et al. | |
| 2006/0016820 | A1 | 1/2006 | Himes et al. | |
| 2008/0023347 | A1 | 1/2008 | Wahl et al. | |
| 2008/0035665 | A1 * | 2/2008 | Edmunds | 221/208 |
| 2011/0114654 | A1 * | 5/2011 | Stern et al. | 220/703 |

* cited by examiner

*Primary Examiner* — Anthony Stashick
*Assistant Examiner* — Madison L Poos
(74) *Attorney, Agent, or Firm* — Richard C Litman

(57) ABSTRACT

The cocktail glass cover is a cover for beverage glasses. The cover is designed with raised ridges on its underside that permit the cover to rest securely on glasses of various sizes. An opening is formed in the cover to receive a straw therethrough. The opening can be optionally closed with a removable knob. The knob is color-coded to allow a drinker to distinguish one beverage from another.

6 Claims, 3 Drawing Sheets

COCKTAIL GLASS COVER

CROSS-REFERENCE TO RELATED APPLICATION

This application claims the benefit of U.S. Provisional Patent Application Ser. No. 61/394,207, filed Oct. 18, 2010.

BACKGROUND OF THE INVENTION

1. Field of the Invention

The present invention generally relates to closures. More specifically, the present invention is drawn to a cover for a cocktail glass or the like.

2. Description of the Related Art

Alfresco dining and entertaining is popular in both urban and suburban areas. Having cocktails (or any beverage) with a friend at a scenic outdoor cafe or with friends and/or family on the patio can bring a special enjoyment to the dining and entertaining experience. Unfortunately, the great outdoors often presents annoyances. Flies, gnats and other flying pests also seem to enjoy tasty libations and sometimes drown themselves in the nectar residing within the cocktail glass. Furthermore, airborne dust and debris also may find its way into the open cocktail glass. In either instance the cocktail may become unpalatable and must be discarded. What a waste! The art would certainly welcome an uncomplicated device that would protect a perfectly made cocktail from flying pests and airborne debris while allowing easy access for the beverage drinker. Thus a cocktail glass cover solving the aforementioned problems is desired.

SUMMARY OF THE INVENTION

The present invention is drawn to a cover for beverage glasses. The cover is designed with raised ridges on its underside that permit the cover to rest securely on glasses of various sizes. An opening is formed in the cover to receive a straw therethrough. The opening can be optionally closed with a removable knob. The knob is color-coded to allow a drinker to distinguish one beverage from another.

Accordingly, the invention presents a cover or lid that provides instant protection from pests and airborne debris. The cover is aesthetically pleasing and easy to use. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
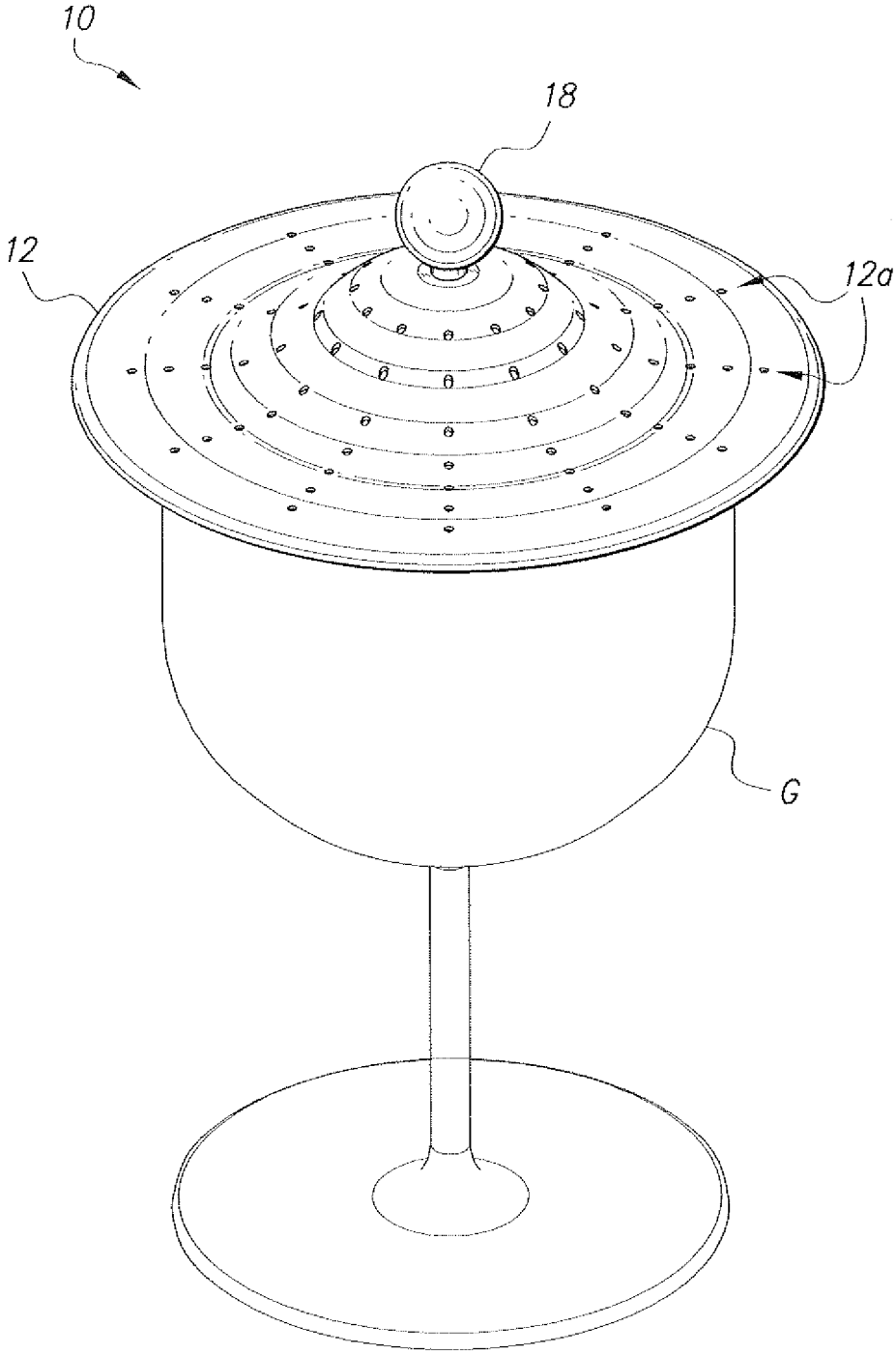
FIG. 1 is an environmental, perspective view of a cocktail glass cover according to the present invention.
Figure 2:
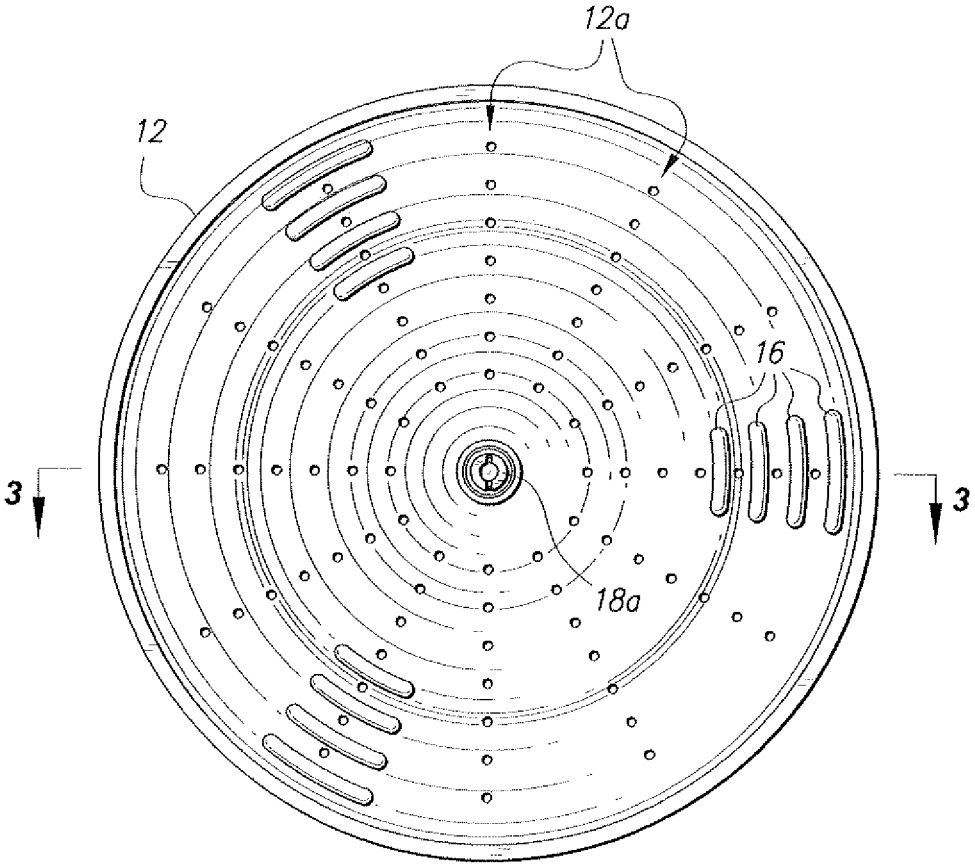
FIG. 2 is a bottom view of a cocktail glass cover according to the present invention.
Figure 3:
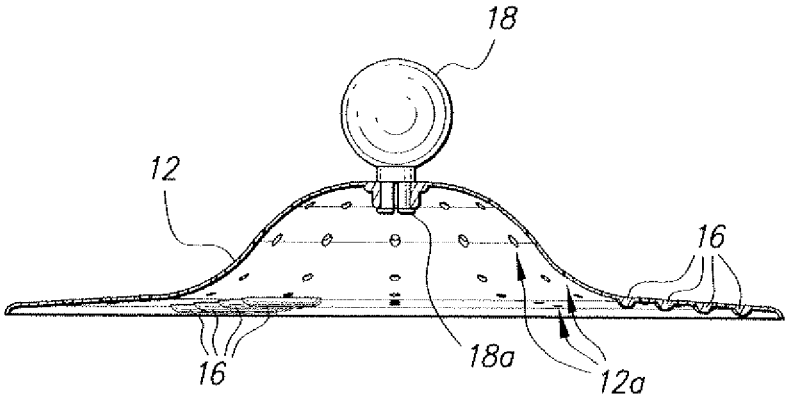
FIG. 3 is a sectioned side view of a cocktail glass cover according to the present invention.
Figure 4:
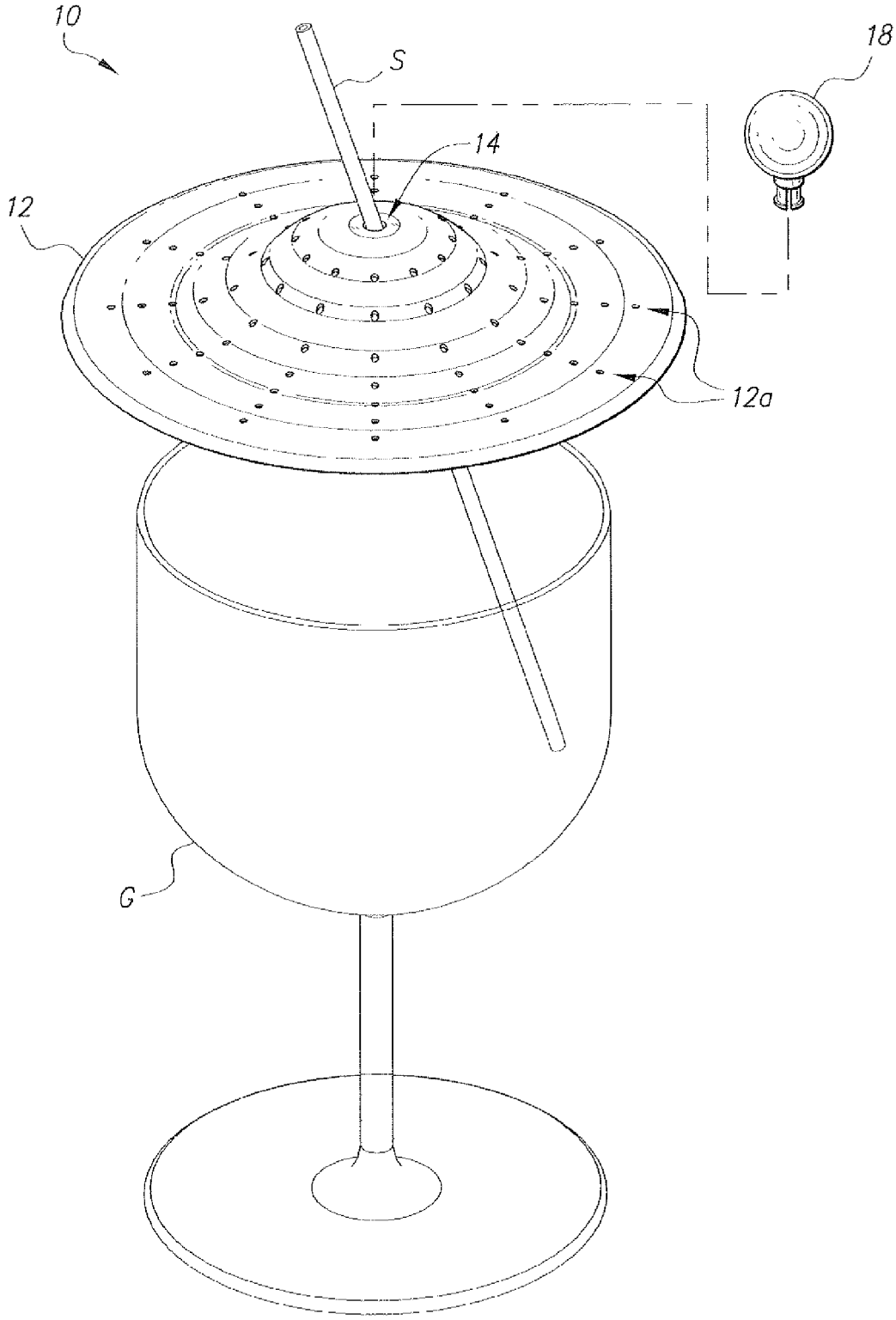
FIG. 4 is an exploded, perspective view of a cocktail glass cover according to the present invention.

Attention is directed to FIGS. 1-4 wherein the cover of the present invention is generally indicated at 10. Cover 10 is adapted to rest atop the opening of a cocktail glass G. Although a cocktail glass is contemplated, the cover can be utilized on almost any beverage glass. Cover 10 comprises a body portion 12 that is fabricated from a non-breakable, non-toxic material such as acrylic. Preferably the body 12 is dome-shaped, whereby the body may fit on the rim most beverage glasses (or beverage containers) that are circular at the top. It should be noted, however, that the cover could be made in other configurations (truncated cone, truncated pyramid, etc), if desired. An opening 14 is formed through the top of body 12. The opening 14 is adapted to receive a straw S therethrough. An array of arced, concentrically spaced ridges 16 is formed on the undersurface of body 12. Ridges 16 function to engage the rim of the cocktail glass to prevent the body from slipping on the glass and also allow the body to fit glasses of various diametric sizes. A color-coded knob 18 is removably received in opening 14 to permit the opening to be closed if no straw is used. The knob 18 is also fabricated from acrylic material or the like and is provided with flexible legs 18*a* for locking or securing the knob in opening 14. An array of small vent holes is formed through the body 12. Vent holes 12*a* function to permit certain beverages, such as red wines, to breathe.

It is to be understood that the present invention is not limited to the embodiment described above, but encompasses any and all embodiments within the scope of the following claims.

We claim:

1. A cocktail glass cover, comprising:

a body member having a top surface, an undersurface, and a single opening formed through the top at a central area thereof, wherein the body has a plurality of vent holes formed therethrough and aligned with the opening;

a knob removably received in and closing the opening; and a plurality of raised, arced, concentric ridges disposed on the undersurface of the body member, the plurality of raised ridges being located in at least two spaced apart regions of the undersurface, wherein a plurality of the vent holes are aligned with and interspersed among the concentric ridges.

2. The cocktail glass cover according to claim 1, wherein said body member is dome-shaped.

3. The cocktail glass cover according to claim 1, wherein said knob has a flexible locking member thereon for securing said knob in the opening in said body.

4. The cocktail glass cover according to claim 1, wherein said body member is fabricated from an acrylic material.

5. The cocktail glass cover according to claim 1, wherein said knob is fabricated from an acrylic material.

6. The cocktail glass cover according to claim 1 in combination with a cocktail glass, wherein the glass has a closed bottom, an open top and a rim surrounding the open top, the top surface of the cover being located outside the glass and the raised ridges on the undersurface engaging the rim of the glass to securely rest the cover on the glass.

* * * * *